US008202055B2

(12) United States Patent
Wu et al.

(10) Patent No.: US 8,202,055 B2
(45) Date of Patent: Jun. 19, 2012

(54) FAN AND IMPELLER

(75) Inventors: Hsiu-Wei Wu, Taoyuan Hsien (TW); Yi-Ling Chen, Taoyuan Hsien (TW); Chieh-Lung Ho, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 691 days.

(21) Appl. No.: 12/405,724

(22) Filed: Mar. 17, 2009

(65) Prior Publication Data

US 2009/0175730 A1 Jul. 9, 2009

Related U.S. Application Data

(63) Continuation-in-part of application No. 11/123,118, filed on May 6, 2005, now abandoned.

(30) Foreign Application Priority Data

May 7, 2004 (TW) ..... 93112882 A

(51) Int. Cl.
*F04D 29/26* (2006.01)

(52) U.S. Cl. ..... 416/210 R

(58) Field of Classification Search ..... 416/211, 416/210 R, 194, 196 A, 196 R, 223 B, 182, 416/183, 184, 185, 186 R, 187
See application file for complete search history.

(56) References Cited

U.S. PATENT DOCUMENTS

| | | | | |
|---|---|---|---|---|
| 580,098 | A | 4/1897 | Williams | |
| 2,106,928 | A | 2/1938 | Lee | |
| 2,442,441 | A | 6/1948 | Shellberg | |
| 4,521,154 | A | 6/1985 | Corbett | |
| 4,589,822 | A | 5/1986 | Clausen et al. | |
| 4,639,193 | A | 1/1987 | Reichert et al. | |
| 6,210,118 | B1 | 4/2001 | Egawa et al. | |
| 6,345,956 | B1 * | 2/2002 | Lin | 416/178 |
| D486,158 | S | 2/2004 | Lei et al. | |
| RE39,117 | E | 6/2006 | Matsumoto | |
| 7,063,510 | B2 * | 6/2006 | Takeshita et al. | 416/210 R |

FOREIGN PATENT DOCUMENTS

JP 2001140790 A * 5/2001

* cited by examiner

*Primary Examiner* — Richard Edgar
(74) *Attorney, Agent, or Firm* — Birch, Stewart, Kolasch & Birch, LLP

(57) ABSTRACT

A fan includes a housing, an impeller and a motor. The impeller includes a hub, a ring and a plurality of flat blades. The ring surrounds the hub without substantial contact therewith and is connected to the hub by at least one connecting arm. The flat blades are disposed on the ring and the active surface of each flat blade has an imaginary extending lines which is which is tangent to a rim of the hub.

11 Claims, 5 Drawing Sheets

FAN AND IMPELLER

RELATED APPLICATIONS

This application is a continuation-in-part of U.S. application Ser. No. 11/123,118, filed on May 6, 2005, which claims priority to Taiwan Application Serial Number 93112882, filed on May 7, 2004, the disclosure of which is hereby incorporated by reference herein in its entirety.

BACKGROUND

The present invention relates to a fan and its impeller, and particularly to the fans capable of reducing windage and noise.

FIG. 1 shows a conventional impeller 100. The impeller 100 includes a hub 102 and a plurality of fan blades 104 directly connected to the hub 102. The frontal surfaces 106 of the fan blades 104 are tangent to the edge of the hub. When the number of fan blades 104 is increased, space between the fan blades 104 is limited, increasing windage and noise of the impeller 100. Conversely, when the number of fan blades 104 is reduced, the total active area of the fan blades 104 is reduced accordingly, thus reducing the airflow efficiency of the impeller 100 of the conventional fan.

Typically, a conventional impeller 100 with thirteen fan blades 104 is employed to balance adequate airflow efficiency without significantly increasing the windage and noise thereof. In a compact electrical device, however, heat dissipation efficiency is enormously required due to the compacted volume thereof, which exceeds the adequate airflow efficiency of the conventional fan with the impeller 100. As a result, a fan with enhanced heat dissipation efficiency and reducing windage and noise thereof is required.

SUMMARY

In view of the problem, an object of the present invention is to provide a fan to enhance heat dissipation and reduce the windage and noise.

In an exemplary embodiment of the present invention, a fan includes a housing, an impeller and a motor. The impeller includes a hub, a ring and a plurality of flat blades. The ring surrounds the hub without substantial contact therewith and is connected to the hub by at least one connecting arm. The flat blades are disposed on the ring and each of the flat blades has an imaginary extending line tangent to a rim of the hub.

In some embodiments, the active surfaces of the flat blades have shapes of rectangles, ladder-sided polygons, tapered polygons, or polygons with taper-and-ladder sides.

In some embodiments, the ring has a rectangular cross-section, an outward tapered shape, an inward tapered shape, or a two-sided tapered shape.

In some embodiments, the connection arm has a rectangular cross-section, a teardrop shape, a polygon, or a rounded polygon.

In some embodiments, the impeller can be used to an axial-flow fan or a blower, and the flat blades do not substantially contact the hub.

A detailed description is given in the following embodiments with reference to the accompanying drawings.

DESCRIPTION OF THE DRAWINGS

The present invention can be more fully understood by reading the subsequent detailed description and examples with references made to the accompanying drawings, wherein.

DETAILED DESCRIPTION

Figure 1:
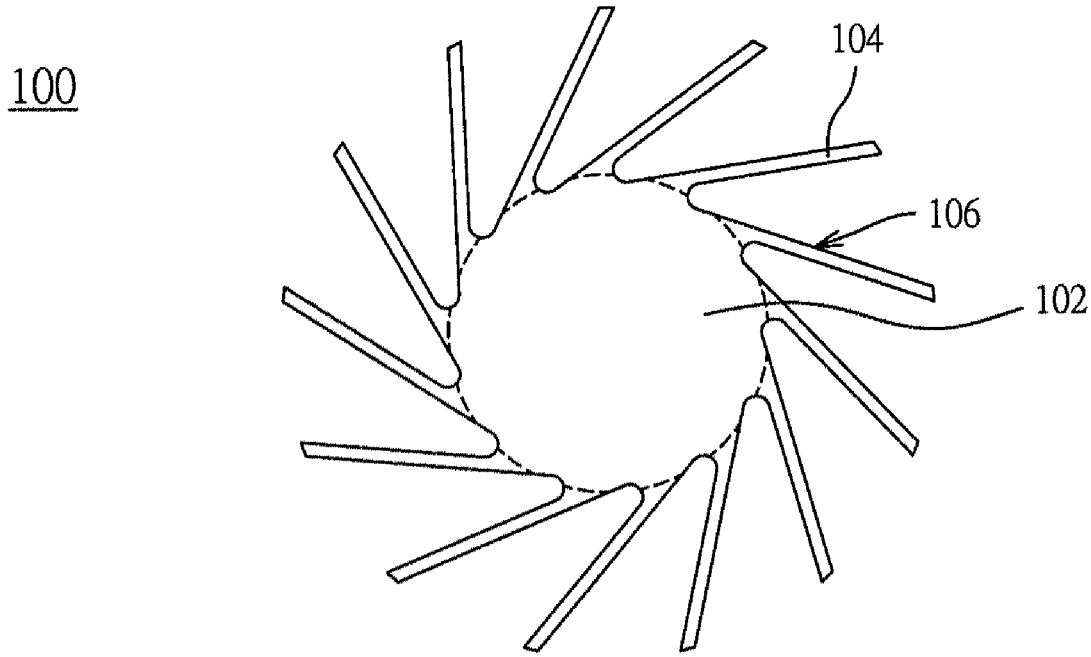
FIG. 1 (RELATED ART)
FIG. 1 is a schematic top view of a conventional fan.
Figure 2A:
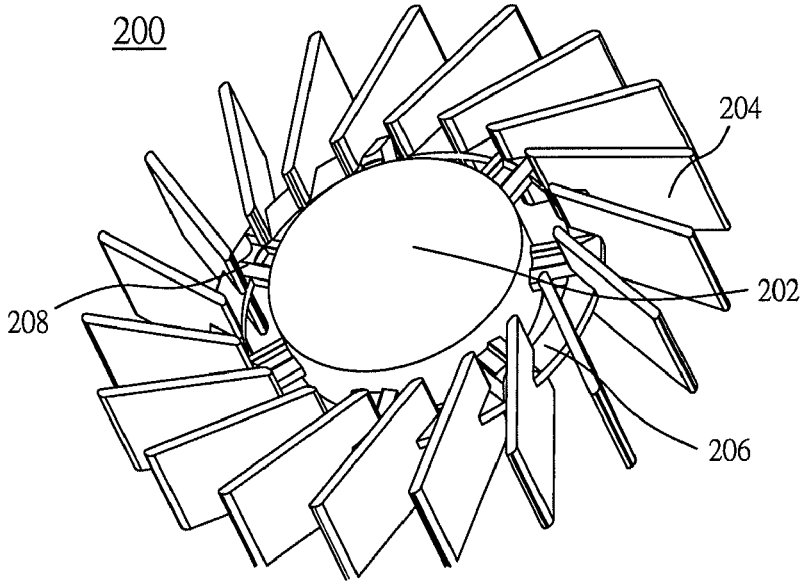
FIG. 2A is a schematic view of an embodiment of an impeller according to the present invention.
Figure 2B:
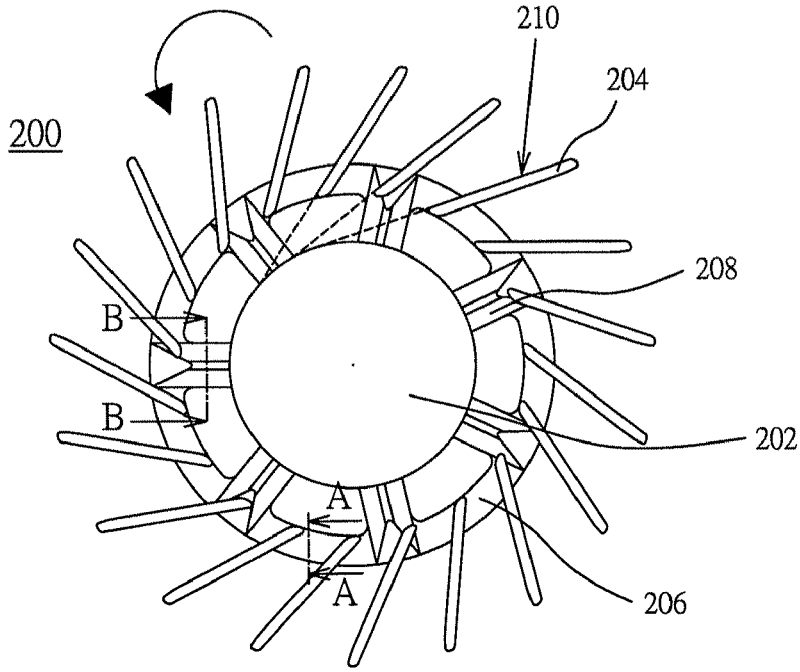
FIG. 2B is a top view of the impeller in FIG. 2A.

Please refer both to FIG. 2A and FIG. 2B, which show an embodiment of an impeller 200. The impeller 200 includes a hub 202, a ring 206, connection arms 208, and a plurality of flat blades 204.

In some embodiments, the hub 202 is a hat-shaped structure with a stator disposed therein. The hub 202 can be made of metal or plastic.

Figure 3:
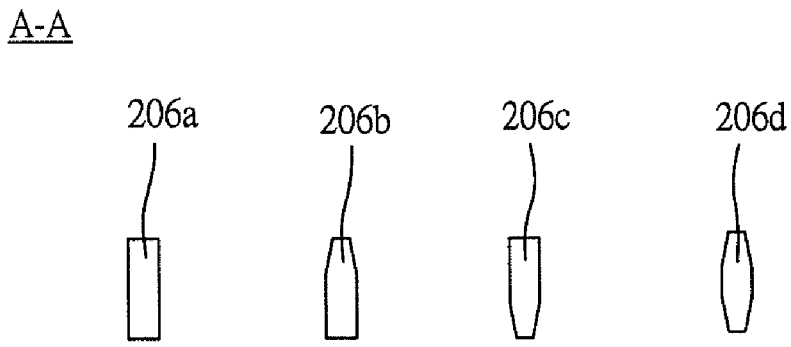
FIG. 3 is a schematic view of some embodiments of cross-sections of the ring of the fan.

The ring 206 is disposed surrounding the hub 202 without substantial contact therewith, and the ring 206 is connected to the hub 202 by the connecting arms 208. In some embodiments, the cross-section of the ring 206 can be a rectangle 206*a*, an outward tapered shape 206*b*, an inward tapered shape 206*c*, or a two-sided tapered shape 206*d*, respectively shown in FIG. 3. When the thickness of the cross-section of the ring 206 varies, the thick portion in the cross-section enhances the structure of the ring 206 for stress and reinforces axial connection between the ring 206 and the flat blades 204. Further, the thin portion in the cross-section increases the total active area of the flat blades 204 and reinforces radial connection between the ring 206 and the flat blades 204. The ring 202 can be made of metal or plastic.

Figure 4:
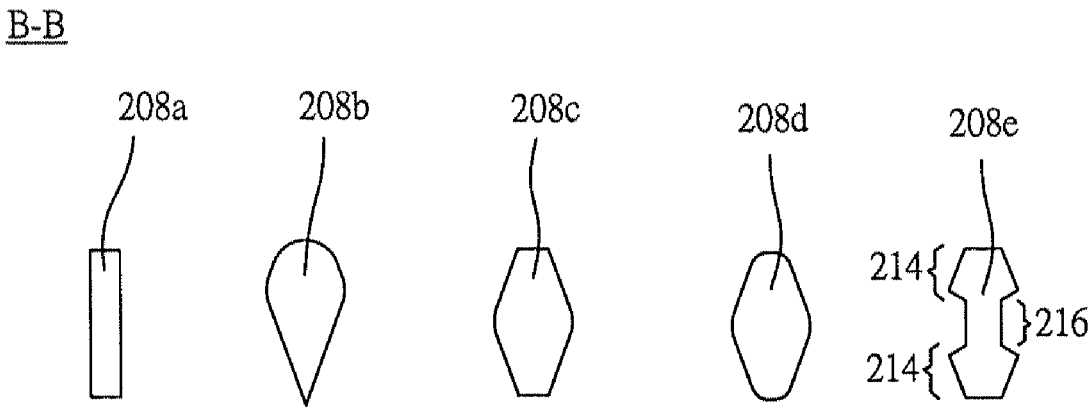
FIG. 4 is a schematic view of some embodiments of cross-sections of the connection arm of the fan.

The connection arms 208 connect the hub 202 and the ring 206. The number and size of the connection arms 208 are not limited. The cross-sections of the connection arms 208 can be a rectangle 208*a*, a teardrop shape 208*b*, a polygon 208*c*, a round-cornered polygon 208*d*, or a bone shape 208*e* with both side portions 214 thereof thicker than a middle portion 216 thereof, respectively shown in FIG. 4. The side portions 214 of the bone shape 208*e* can be tapered. When at least one side portion of the connection arm 208 is tapered, the connection arm 208 enhances the airflow efficiency and reduces windage of the impeller 200. Further, when the side portions of the connection arm 208 are thicker than the middle portion thereof, the windage can be further reduced. The connection arms 208 can be metal or plastic.

The flat blades 204 are disposed radially on the ring 206 around the hub 202 and substantially horizontally extended outwardly, and the active surface 210 of each of the flat blades 204 has an imaginary extending line 302 which is tangent to a rim of the hub. The active surface 210 means the surface of the flat blades which meets air directly. Take an example in FIG. 2B, the rotation direction of the impeller 200 is counter wise, and the active surface is indicated as symbol "210". One end of the blades 204 contact with the ring 206, and other end of the blades 204 don't contact with the ring 206. Thus, windage of the flat blades 204 is minimized, and the airflow efficiency of the impeller 200 is enhanced.

Figure 5:
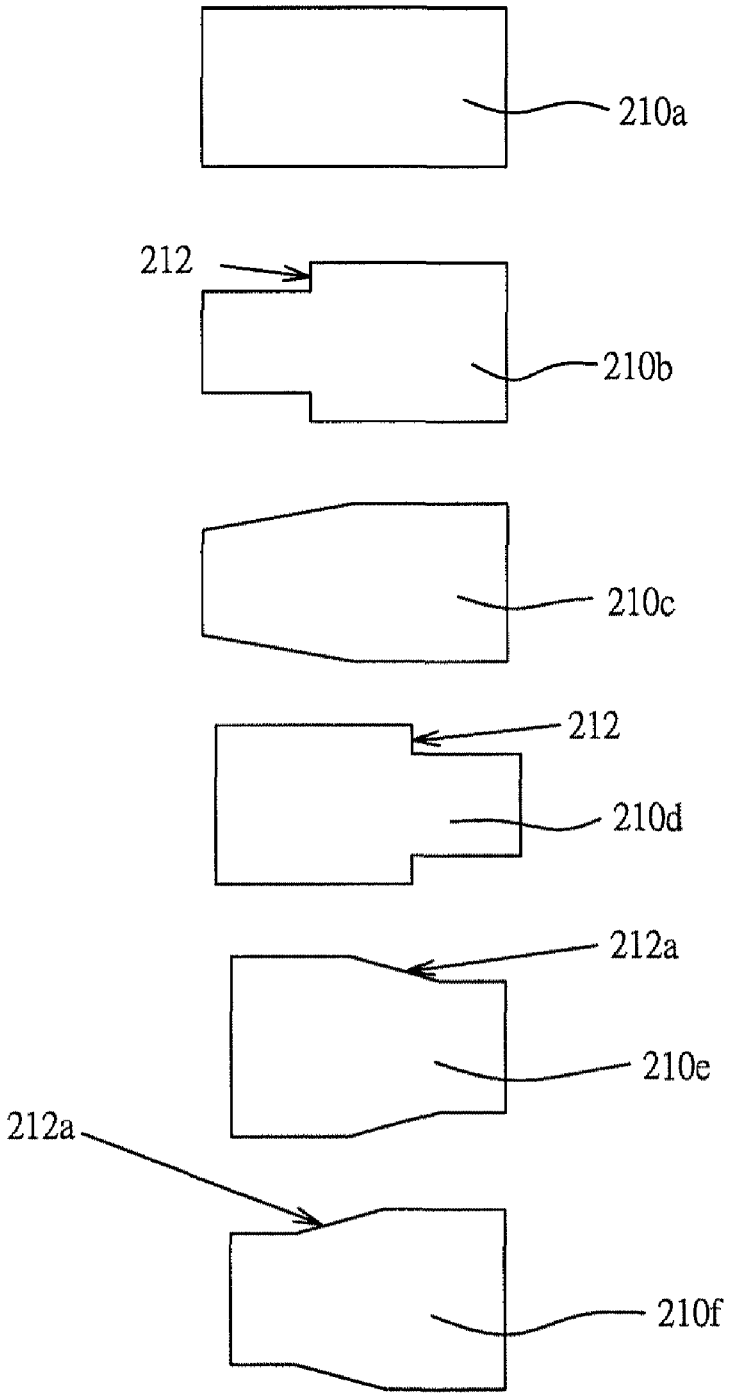
FIG. 5 is a schematic view of some embodiments of cross-sections of the flat blades of the fan.

The active surfaces 210 can be flat to maximize the total active area of the flat blades 204. In some embodiments, the active surfaces 210 have rectangular shapes 210*a*, ladder-sided polygons 210*b* and 210*d* with ladder sides 212, tapered polygons 210*c*, and polygons 210*e* and 210*f* with taper-and-ladder sides 212*a*, respectively shown in FIG. 5.

Because the flat blades 204 are disposed on the ring 206 without substantial contact to the hub 202, and the imaginary extending lines of the active surfaces 210 of the flat blades 204 are tangent to a rim of the hub, thus when the imaginary extending lines of flat blades 204 crisscross with other, space between the flat blades 204 is maintained with desired windage. As a result, the number of the flat blades 204 can potentially be increased to more than thirteen to enhance airflow efficiency without significantly increasing the windage and noise of the impeller 200. In some embodiments, sixteen to twenty flat blades 204 can be employed.

Figure 6A:
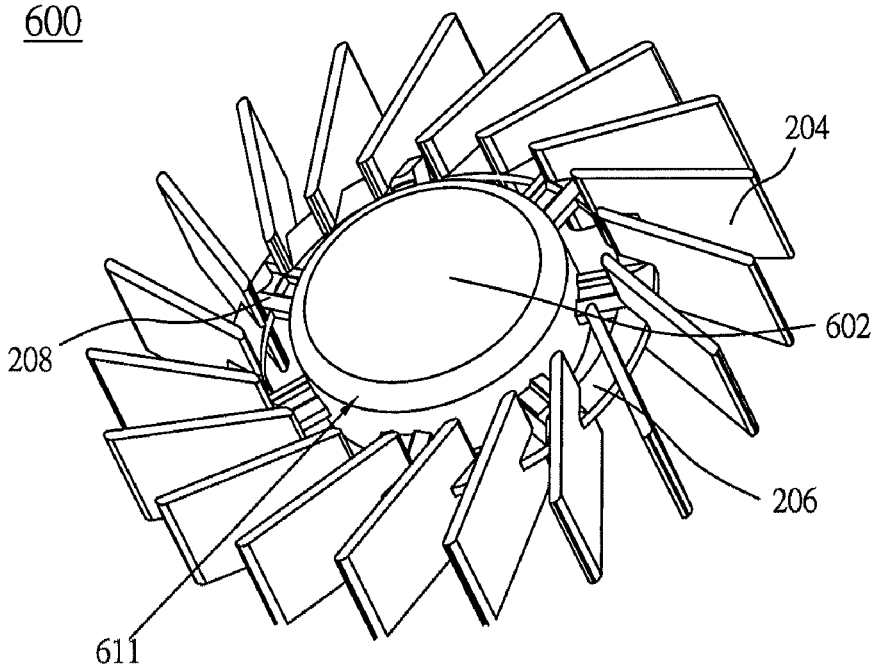
FIG. 6A is a schematic view of another embodiment of the impeller according to the present invention.
Figure 6B:
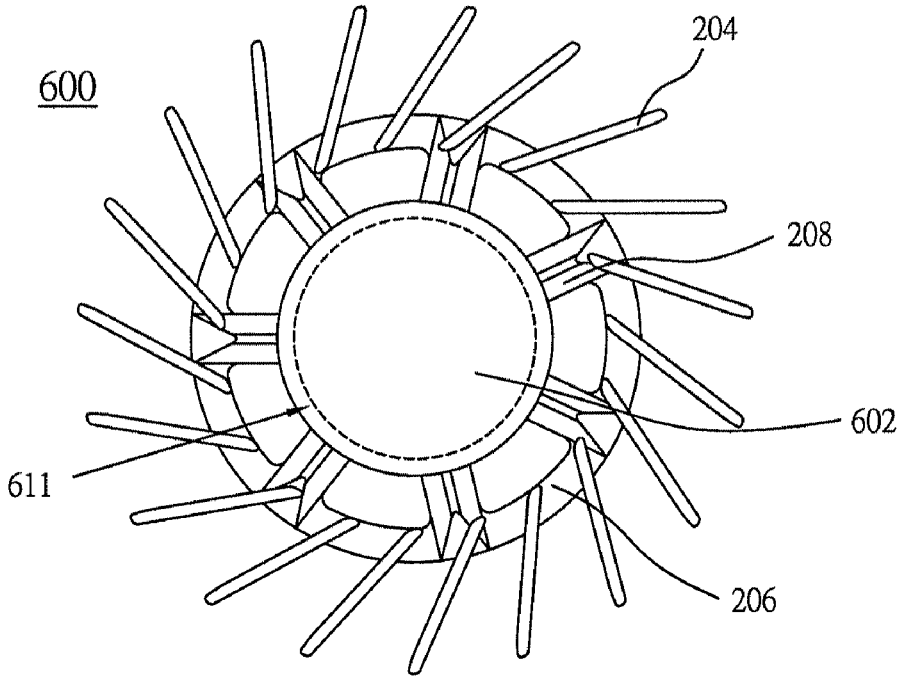
FIG. 6B is a top view of the impeller in FIG. 6A.

Further, please referring to FIG. 6A and FIG. 6B, which show another embodiment of the impeller 600 according to the present invention. In this embodiment, the ring 206, the connection arms 208, and the plurality of flat blades 204 are the same as those of the embodiment of FIG. 2A mentioned hereinabove, so detailed descriptions thereof will be omitted. At the top of the hub 602 of the impeller 600, it has a round angle 611 at the rim of the hub 602 for smoothly introducing and guiding airflows into the impeller 600 when the impeller rotates. But this is not limited thereto, it may has a R angle or other equivalents formed at the rim of the hub 602 as long as they can have functions of smoothly introducing and guiding airflows into the impeller 600.

Moreover, the impeller 200/600 may be used to an axial-flow fan or a blower, i.e. a side-blown fan. No matter the axial-flow fan or the blower, both of them include a housing, the above-mentioned impeller and a motor. The motor is for driving the impeller to rotate, and both of the motor and the impeller are accommodated within the housing.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising:

an impeller, comprising:

a hub;

a ring surrounding the hub without substantial contact therewith and connected to the hub by at least one connection arm; and a plurality of flat blades radially disposed on the ring and substantially horizontally extended outwardly, each of the flat blades comprising an active surface, wherein imaginary extending lines of the active surfaces are tangent to a rim of the hub rim of the hub, wherein the connection arm has a bone shape cross-section with both side portions thereof thicker than a middle portion thereof.

2. The fan as claimed in claim 1, wherein the active surfaces are rectangular, ladder-sided polygons, tapered polygons, or polygons with taper-and-ladder sides.

3. The fan as claimed in claim 1, wherein the ring has a rectangular, an outward tapered, an inward tapered, or a two-sided tapered cross-section.

4. The fan as claimed in claim 1, wherein the side portions of the bone shape are tapered.

5. The fan as claimed in claim 1, wherein the fan is an axial-flow fan or a blower.

6. The fan as claimed in claim 1, wherein the flat blades do not substantially contact the hub.

7. The fan as claimed in claim 1, wherein one end of each of the flat blades contacts with the ring, and other end of each of the flat blades does not contact with the ring.

8. The fan as claimed in claim 1, wherein at an top of the hub of the impeller, a round angle, a R angle or other equivalents is formed at the rim of the hub for smoothly introducing and guiding airflows into the impeller when the impeller rotates.

9. The fan as claimed in claim 1, further comprising a housing, an impeller and a motor, wherein the motor is for driving the impeller to rotate, and both of the motor and the impeller are accommodated within the housing.

10. An impeller, comprising:

a hub;

a ring surrounding the hub without substantial contact therewith and connected to the hub by at least one connection arm; and a plurality of blades disposed on the ring, each of the blades comprising an active surface, wherein imaginary extending lines of the active surfaces are tangent to a rim of the hub, wherein the connection arm has a bone shape cross-section with both side portions thereof thicker than a middle portion thereof, and the side portions of the bone shape are tapered.

11. The impeller as claimed in claim 10, wherein at an top of the hub of the impeller, a round angle, a R angle or other equivalents is formed at the rim of the hub for smoothly introducing and guiding airflows into the impeller when the impeller rotates.

* * * * *